US011274870B2

(12) United States Patent
Provest

(10) Patent No.: US 11,274,870 B2
(45) Date of Patent: Mar. 15, 2022

(54) MODULAR COOLROOM SYSTEM AND COOLROOM MODULES THEREFOR

(71) Applicant: Prestige Marketing Suites Australia Pty Ltd, Southbank (AU)

(72) Inventor: David Phillip Provest, Southbank (AU)

( * ) Notice: Subject to any disclaimer, the term of this patent is extended or adjusted under 35 U.S.C. 154(b) by 236 days.

(21) Appl. No.: 16/368,979

(22) Filed: Mar. 29, 2019

(65) Prior Publication Data

US 2020/0309441 A1 Oct. 1, 2020

(51) Int. Cl.
*F25D 11/00* (2006.01)
*F25D 23/06* (2006.01)

(52) U.S. Cl.
CPC ..... *F25D 11/003* (2013.01); *F25D 23/063* (2013.01); *F25D 2201/12* (2013.01); *F25D 2323/02* (2013.01); *F25D 2400/12* (2013.01); *F25D 2400/14* (2013.01); *F25D 2400/32* (2013.01)

(58) Field of Classification Search
CPC .. F25D 11/003; F25D 23/063; F25D 2201/12; F25D 2323/02; F25D 2400/12; F25D 2400/14; F25D 2400/32; B65D 88/005; B65D 88/022; B65D 88/027; B65D 88/745
See application file for complete search history.

(56) References Cited

U.S. PATENT DOCUMENTS 5,161,848 A * 11/1992 Button ..... B60H 1/3232 296/181.6
5,245,838 A * 9/1993 Cavalea, III ..... B65D 90/08 62/259.1
5,649,432 A 7/1997 Cavalea, III
2007/0271857 A1 11/2007 Heather et al.
2010/0074723 A1* 3/2010 Lancon ..... B65D 88/005 414/800
2018/0209137 A1* 7/2018 Carlyon ..... E04C 2/384
2019/0145699 A1* 5/2019 Mellits ..... F25D 23/067 312/406

* cited by examiner

*Primary Examiner* — Joseph F Trpisovsky
(74) *Attorney, Agent, or Firm* — Gallet Dreyer & Berkey LLP; Andrew Berks

(57) ABSTRACT

A transportable coolroom module is provided including a base frame and a coolroom structure mounted on the base frame, wherein the coolroom structure includes a floor, a plurality of walls each extending above the floor, and a roof supported by the walls. At least one access door may be provided in at least one of the walls, and at least one removable infill panel may be provided in at least one of the other walls. The removable infill panel may be attached to the coolroom structure. The transportable coolroom module may be used as a stand-alone coolroom. The at least one removable infill panel may be selectively removed from the coolroom structure and the transportable coolroom module may be selectively interconnected with one or more other like transportable coolroom modules to create a larger combined coolroom environment.

19 Claims, 12 Drawing Sheets

MODULAR COOLROOM SYSTEM AND COOLROOM MODULES THEREFOR

TECHNICAL FIELD

The present invention relates generally to modular storeroom structures, and relates particularly, though not exclusively, to transportable modular refrigerated storeroom structures or "modular coolrooms". More particularly, the present invention relates to a modular coolroom system, and coolroom modules therefor, wherein the individual coolroom modules may be used as stand-alone coolrooms, or may be selectively interconnected with other coolroom modules, as desired, to create a larger combined coolroom environment.

It will be convenient to hereinafter describe the invention in relation to modular refrigerated storeroom structures, or "modular coolrooms", however it should be appreciated that the present invention is not limited to that use only. For example, other forms of climate controlled (e.g. heated, humidity controlled, etc.), or non-climate controlled modular storeroom structures may also be readily made in accordance with the teachings of the present invention. A skilled person will appreciate many possible uses and modifications of the modular storeroom structures, systems and/or methods of the present invention. Accordingly, the present invention as hereinafter described should not be construed as limited to any one or more of the specific examples provided herein, but instead should be construed broadly within the spirit and scope of the invention as defined in the description and claims that now follows.

BACKGROUND ART

Any discussion of documents, devices, acts or knowledge in this specification is included to explain the context of the invention. It should not be taken as an admission that any of the material forms a part of the prior art base or the common general knowledge in the relevant art in the United States of America or elsewhere on or before the priority date of the disclosure herein.

Refrigerated or other forms of climate-controlled storeroom structures (hereinafter simply referred to as "coolrooms") are commonly used in both commercial and residential environments for the purpose of storing goods, especially perishable goods, such as, for example, food, beverages, plants, flowers, chemicals or pharmaceuticals. Where budgets, lease conditions and/or government building and planning requirements permit, such coolrooms may be purpose built and permanent or fixed in nature. Otherwise, it is common practice to purchase or rent transportable coolrooms for either permanent or temporary storage requirements. Common transportable coolrooms include refrigerated shipping containers typically known as "Reefers", or mobile or portable coolrooms which are affixed to trailers.

A problem with such known transportable coolrooms is that they are not designed to be interconnected with one another. Meaning, if more storage space is required, whilst multiple such transportable coolrooms may be utilised and arranged alongside each other, the end result is multiple separate storeroom environments and not a single combined open storeroom environment. Hence, whilst utilising multiple known transportable coolrooms may provide the additional storage space required, if goods are to be moved from one coolroom to another it is necessary to move in and out of the various coolrooms to load and unload the goods as required. Aside from the inconvenience of having to move in and out of multiple coolrooms, the internal dimensions of each separate coolroom may not readily permit storage of large or irregular sized goods.

A need therefore exists for modular storeroom structures, systems and/or methods, wherein individual storeroom modules may be used as stand-alone storerooms, or may be selectively interconnected with other storeroom modules, as desired, to create a larger combined storeroom environment. More particularly, a need exists for transportable modular coolroom structures, systems and/or methods, wherein individual coolroom modules may be used as stand-alone coolrooms, or may be selectively interconnected with other coolroom modules, as desired, to create a larger combined coolroom environment.

DISCLOSURE OF THE INVENTION

Accordingly, in one aspect, the present invention provides a transportable storeroom module comprising: a base frame; a storeroom structure mounted on the base frame, the storeroom structure including a floor, a plurality of walls each extending above the floor, and a roof supported by the plurality of walls; at least one access door provided in at least one of the plurality of walls of the storeroom structure; and, at least one removable infill panel provided in at least one other of the plurality of walls of the storeroom structure; wherein when the at least one removable infill panel is attached to the storeroom structure, the transportable storeroom module may be used as a stand-alone storeroom; and, wherein when the at least one removable infill panel is selectively removed from the storeroom structure, the transportable storeroom module may be selectively interconnected with one or more other like transportable storeroom modules to create a larger combined storeroom environment.

Preferably, the storeroom structure is generally insulated, with at least the plurality of walls and the roof comprising one or more insulated panels.

Preferably, the storeroom structure is generally rectangular in shape and includes a front wall, a rear wall, and left and right side walls, respectively. In such a preferred embodiment, it is also preferred that one access door is provided in the front or the rear wall, and one, but preferably two, removable infill panel or panels is/are provided in the left and/or right side walls.

Preferably, the or each removable infill panel is horizontally centrally located on the left and/or right side wall, and extends vertically from the floor to a point which is around 70 to 90% of the height of the left and/or right side wall, preferably around 80 to 85% of the height of the left and/or right side wall, and more preferably around 83% of the height of the left and/or right side wall. It is also preferred that an infill opening exposed by selectively removing the or each removable infill panel is around 50 to 70% of the length of the left and/or right side wall, preferably around 55 to 65% of the length of the left and/or right side wall, and more preferably around 60% of the length of the left and/or right side wall.

Preferably, the or each removable infill panel includes at least one handle to assist with selectively installing and/or removing the infill panel to/from the storeroom structure.

Preferably, the storeroom structure is adapted for storing palletised goods. It is also preferred that a ramp is selectively positioned at the or each access door to assist with moving goods, preferably palletised goods, into and out of the storeroom structure.

Preferably, the storeroom structure is a coolroom structure. In such a preferred embodiment, it is preferred that the base frame extends in one direction beyond the floor of the coolroom structure to provide an extension area, the extension area being adapted to support one or more refrigeration components necessary to control the climate within the coolroom structure.

According to a further aspect, the present invention provides a modular system for construction of a storeroom structure comprising: a plurality of transportable storeroom modules according to any one of the preceding paragraphs; and, means for interconnecting the plurality of transportable storeroom modules in order to construct the storeroom structure.

Preferably, the means for interconnecting the plurality of transportable storeroom modules includes sealing tape or sealant, a plurality of latches, and flashings to cover gaps between respective interconnected transportable storeroom modules.

According to yet a further aspect, the present invention provides a storeroom structure comprising a plurality of transportable storeroom modules according to any one of the preceding paragraphs interconnected with one another.

According to still yet a further aspect, the present invention provides a method of constructing a storeroom structure, the method comprising the steps of: providing a plurality of transportable storeroom modules according to any one of the preceding paragraphs; horizontally arranging the plurality of the transportable storeroom modules side-by-side on a substantially flat ground surface; removing the infill panels from respective opposing wall surfaces, if not removed beforehand; and, interconnecting the plurality of transportable storeroom modules to create the storeroom structure.

Preferably, the step of interconnecting the plurality of transportable storeroom modules includes: applying a sealing tape or sealant to at least one, but preferably both, of each of the respective opposing wall surfaces; successively moving or drawing the respective opposing wall surfaces into contact with one another, such that a substantially airtight seal is created between the respective opposing wall surfaces by way of the sealing tape or sealant; locking the respective opposing wall surfaces together by way of a plurality of latches; and, applying a flashing over gaps between respective interconnected transportable storage modules.

These and other essential and/or preferred aspects and features of the present invention will be apparent from the description that now follows.

BRIEF DESCRIPTION OF THE DRAWINGS

In order that the invention may be more clearly understood and put into practical effect there shall now be described in detail preferred modular storeroom structures, systems and/or methods, preferably transportable modular coolroom structures, systems and/or methods, in accordance with the invention. The ensuing description is given by way of non-limitative examples only and is with reference to the accompanying drawings, wherein.

MODES FOR CARRYING OUT THE INVENTION

Figure 1:
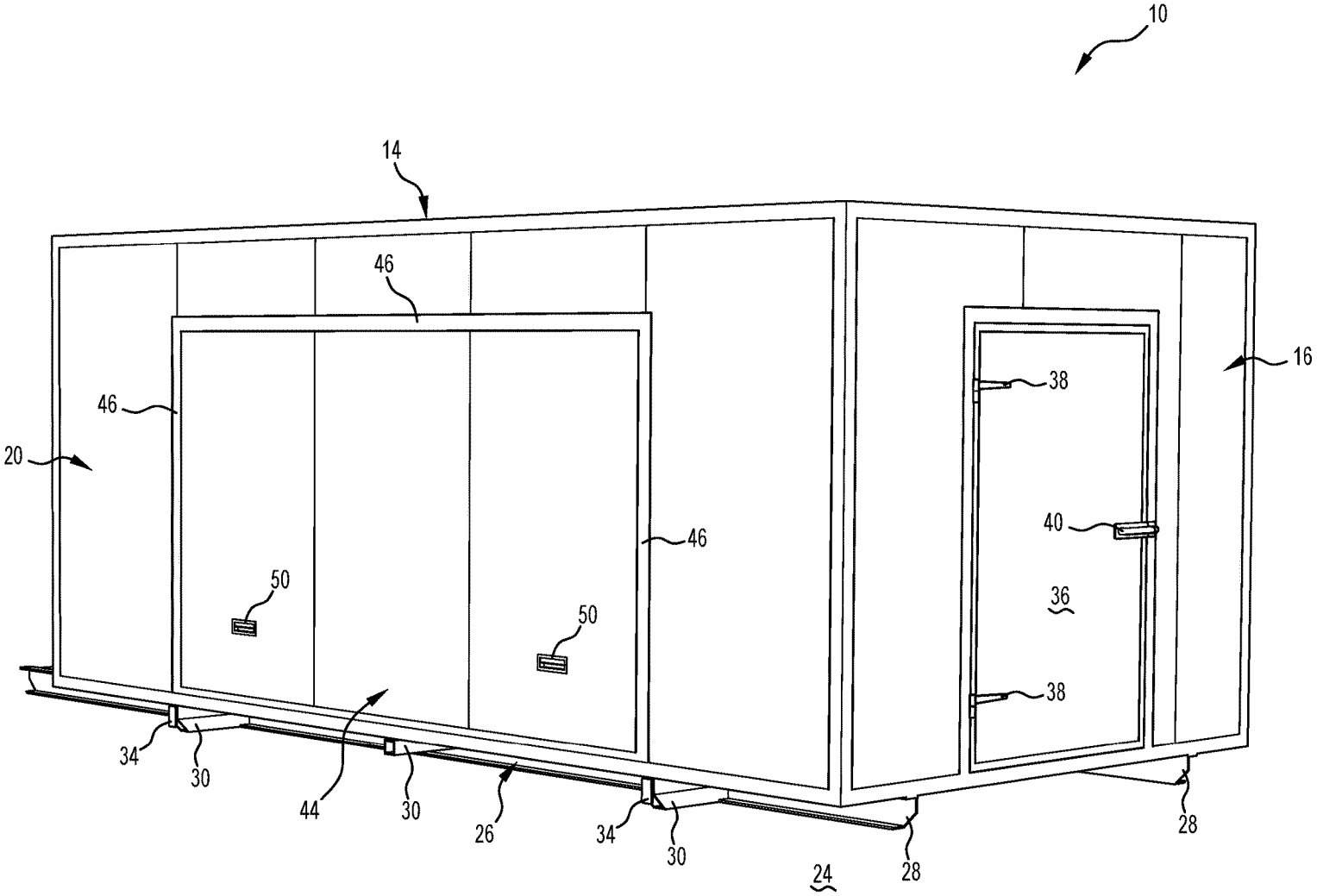
FIG. 1 is a front perspective view of a coolroom module suitable for use as a stand-alone coolroom, or as part of a modular coolroom system, the coolroom module and modular coolroom system being made in accordance with preferred embodiments of the present invention.

The following is a detailed description of the invention with reference to the preferred embodiment(s) shown in the drawings. In the detailed description and in the drawings, like reference numerals refer to like elements throughout. Those elements are intended to show by way of illustration specific embodiments in which the invention may be practiced. It is to be understood that other embodiments may be utilised and that procedural and/or structural changes may be made without departing from the spirit and scope of the invention.

In FIGS. 1 to 4*b*, there is shown a preferred embodiment of a transportable storeroom module 10 which is preferably refrigerated, or otherwise climate controlled, as shown. Although described hereinafter as being a refrigerated storeroom module(s) 10 (hereinafter simply referred to as "coolroom module(s) 10" or "coolroom module(s) $\mathbf{10}_x$"), it will be appreciated that modules 10 made in accordance with the present invention are not limited to that use only. The present invention should therefore not be construed as limited to the specific example provided and/or shown in the drawings.

Coolroom module 10 is suitable for use as a stand-alone coolroom (as shown, for example, in FIGS. 1 to 3), or may be utilised as part of a modular coolroom system 100 (see, for example, FIGS. 5 to 10), wherein multiple like coolroom modules $\mathbf{10}_x$ (for example, coolroom modules $\mathbf{10}_1$ to $\mathbf{10}_3$, as shown in FIGS. 5 to 10) may be selectively and removably interconnected with one another, as desired, to create a larger combined coolroom environment.

Figure 2:
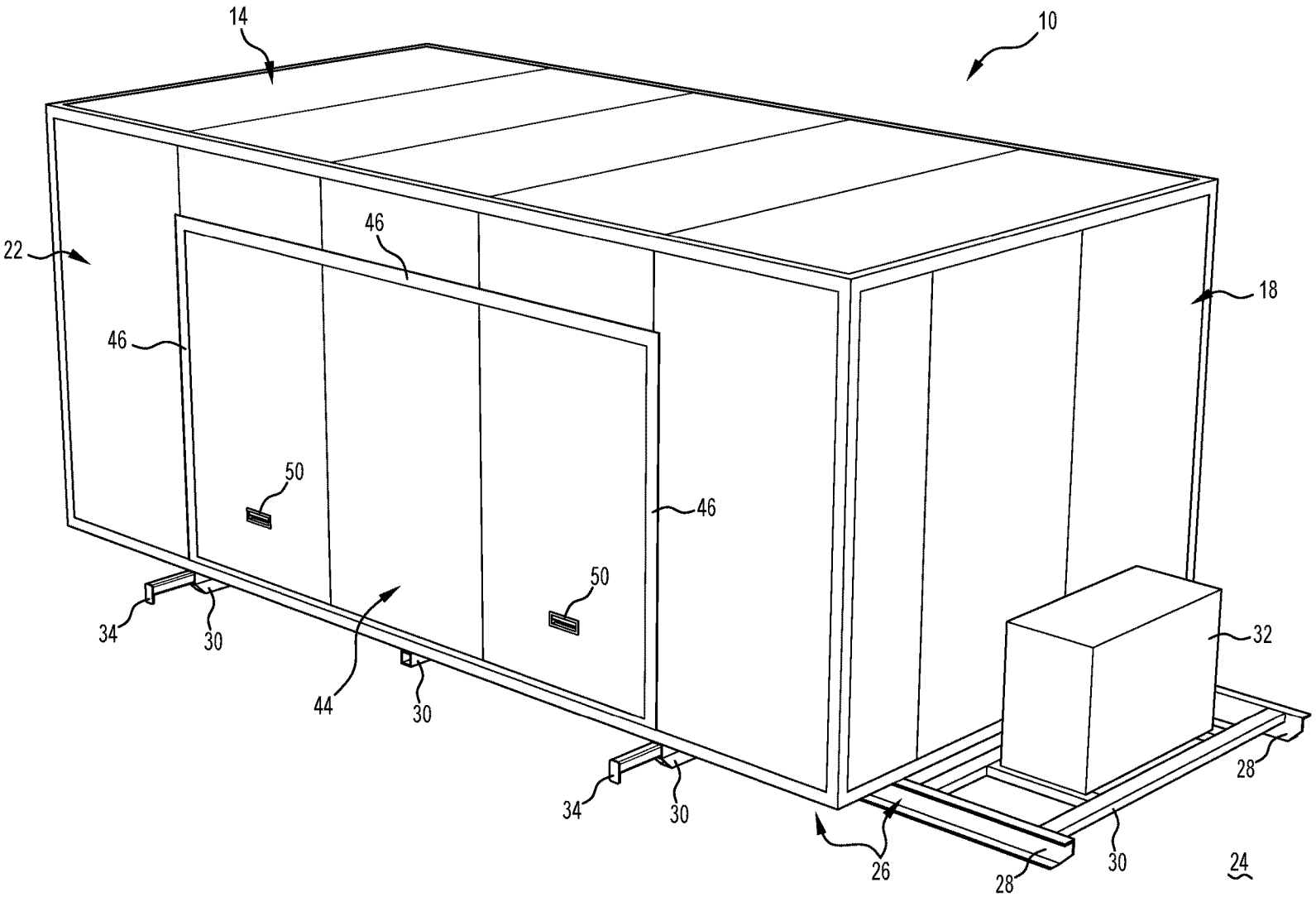
FIG. 2 is a rear perspective view of the preferred coolroom module shown in FIG. 1.
Figure 3:
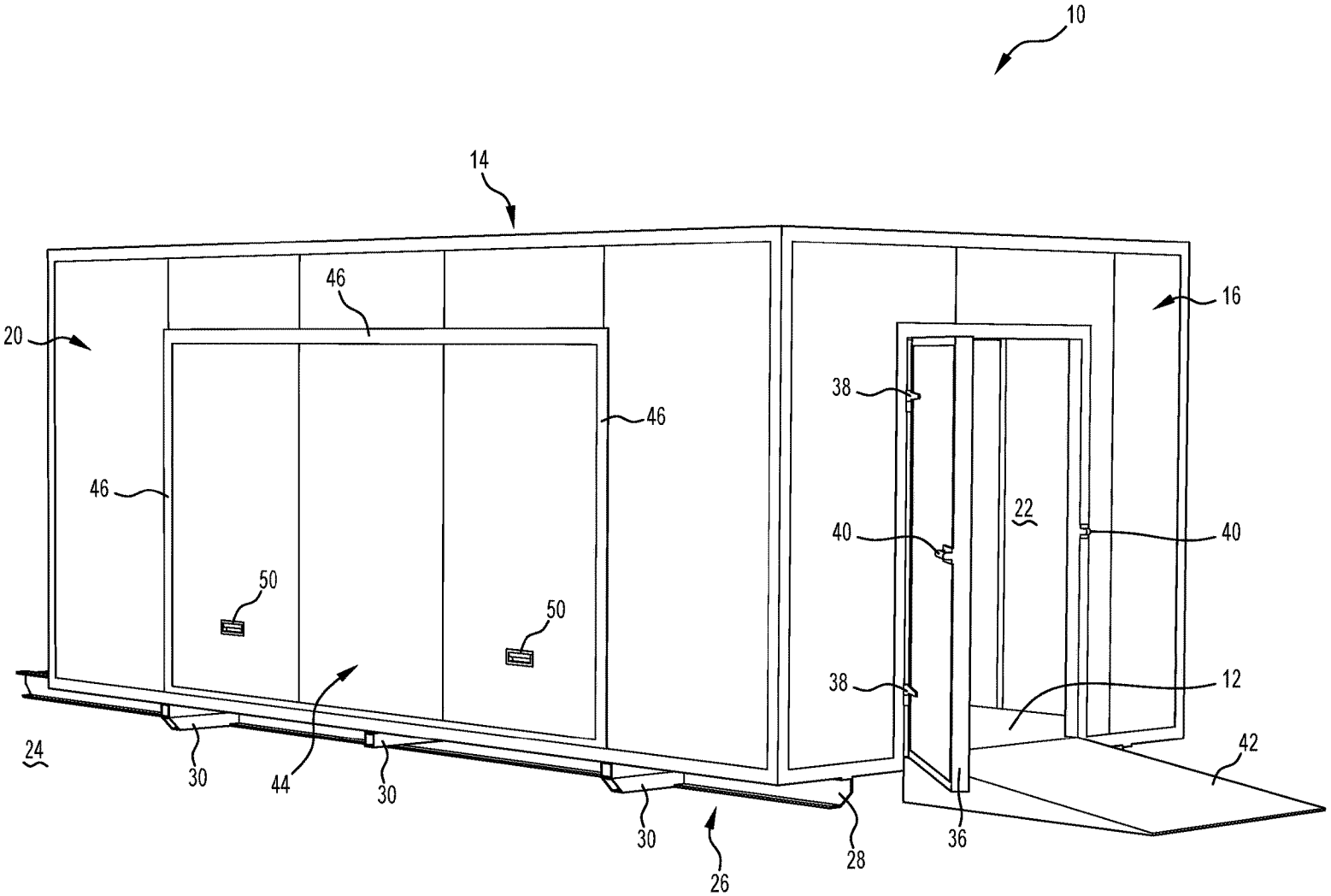
FIG. 3 is a similar view to that of FIG. 1, this time showing a door of the preferred coolroom module in an open state, with an exemplary ramp disposed at the door opening to facilitate access into or out of the preferred coolroom module.
Figure 4A:
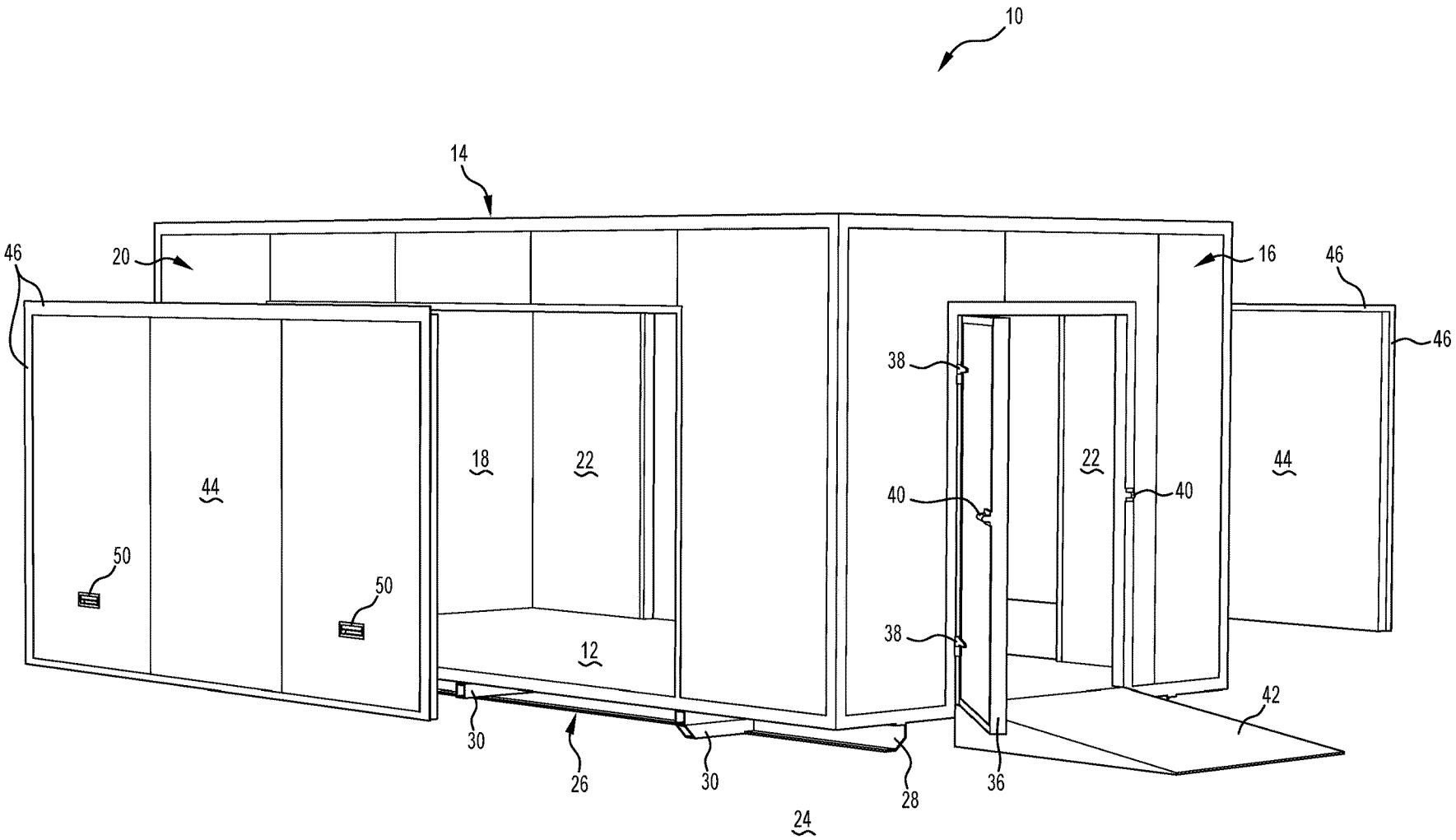
FIGS. 4*a* & 4*b* are similar views to that of FIGS. 3 & 1, respectively, this time showing in stages how one or more preferred side infill panels of the preferred coolroom module may be removed so as to enable the module to be selectively interconnected with one or more other like coolroom modules in order to create a larger combined coolroom environment in accordance with the preferred modular coolroom system of the present invention.
Figure 4B:
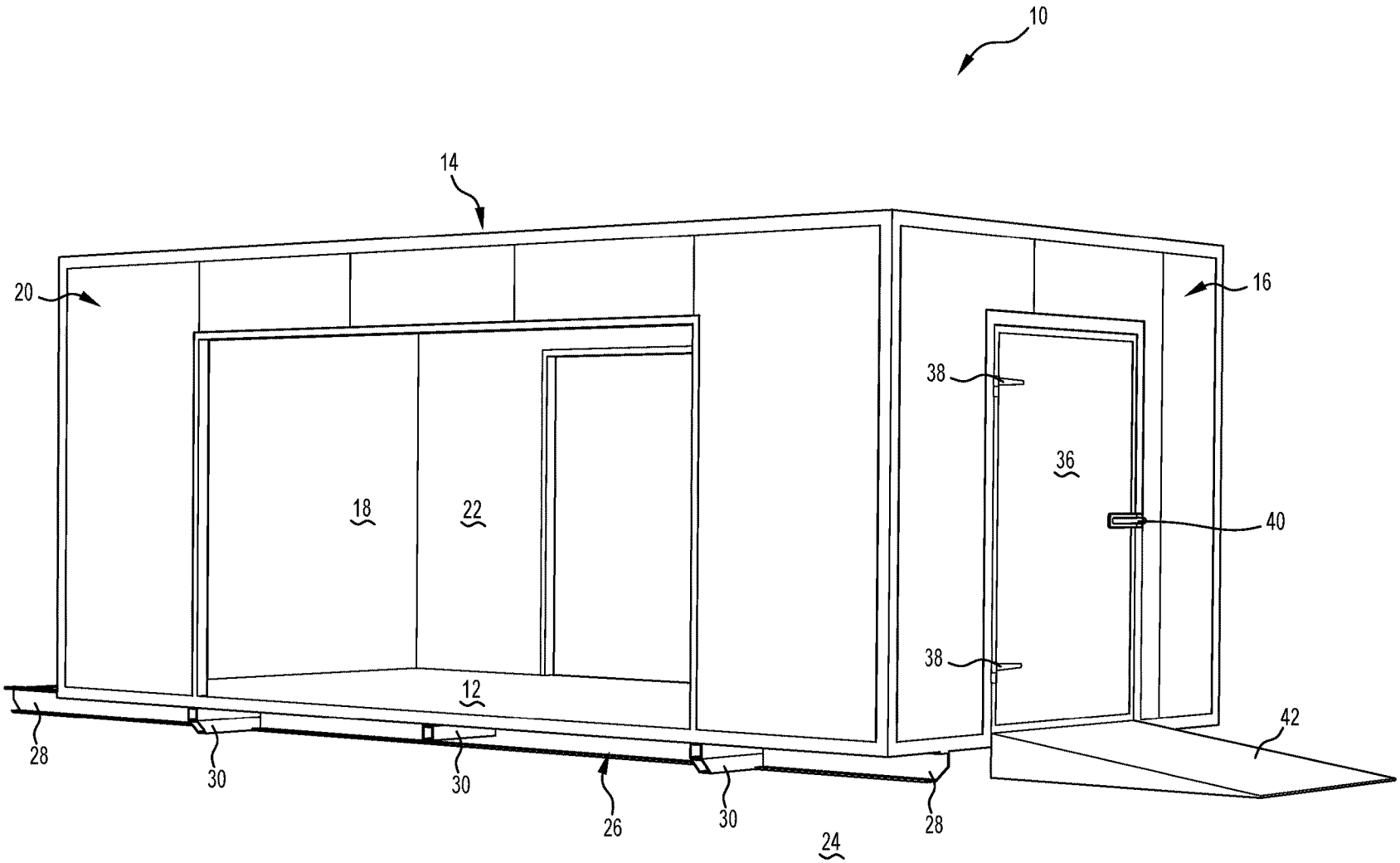
Figure 5:
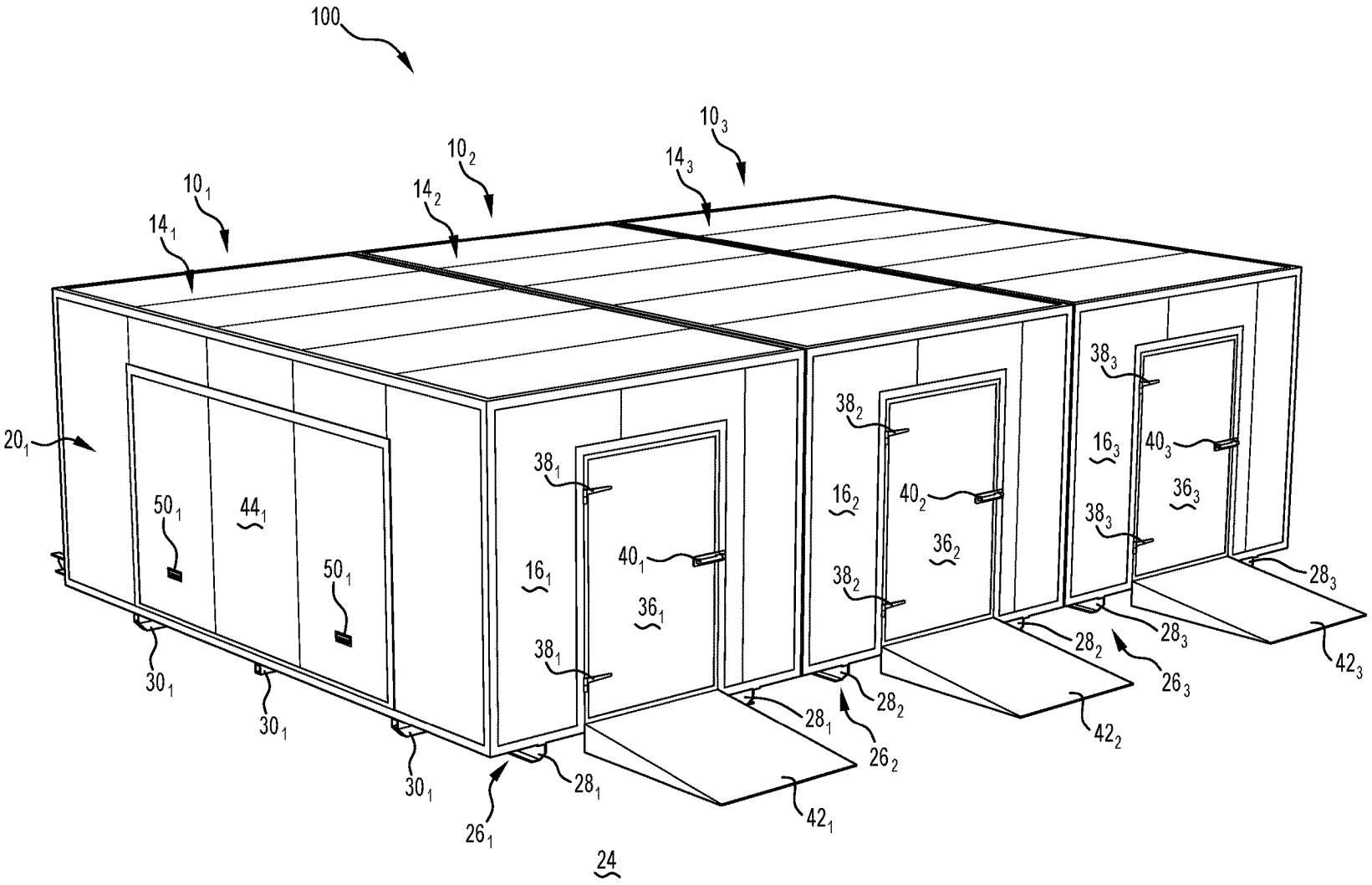
FIG. 5 is a front perspective view of three preferred coolroom modules interconnected with one another creating a larger combined coolroom environment in accordance with the preferred modular coolroom system of the present invention.

Referring to FIGS. 1, 2 & 4*b*, in particular, it can be seen that coolroom module 10 comprises an insulated structure which is preferably generally rectangular in shape (but which may be any other suitable shape as desired), which includes a floor 12, a roof 14, front and rear walls 16 & 18, and left and right side walls 20 & 22, respectively. Each of the roof 14, front and rear walls 16 & 18, and left and right side walls 20 & 22, are generally comprised of one or more insulated panels as shown. The various insulated roof 14 and wall 16, 18, 20 & 22 panels may be made of any suitable insulated material and may vary in thickness depending on the application of coolroom module 10. Whilst any suitable insulated roof 14 and wall 16, 18, 20 & 22 panels, and thickness thereof, may be readily used in accordance with the present invention, it has been found that insulated panels of a thickness of around 75 mm having an EPS ("Expanded Polystyrene") core sandwiched between two Colorbond® steel facings, and aluminium perimeter capping of around 75 mm×38 mm, are particularly well suited for typical coolroom applications.

Although not shown in detail in the drawings, where the respective roof 14 and wall 16, 18, 20 & 22 panels are connected to one another, and where the wall 16, 18, 20 & 22 panels connect to the floor 12, it is preferred that an airtight seal (or a substantially airtight seal) is created between respective panels 14, 16, 18, 20 & 22, and the floor 12, using any suitable joint technique(s) (e.g. butt joints, mitre joints, etc.), sealant(s), fittings and/or fastening means. For example, to create an airtight seal where the roof 14 panel(s) is/are joined to the wall 16, 18, 20 & 22 panels, mitre joints may be utilised all around to allow continuous contact with the preferred EPS material of the respective panels 14, 16, 18, 22 & 22. Likewise, to create and/or to assist with creating an airtight seal at each of the respective roof 14 and wall 16, 18, 20 & 22 panel joints, a 900 angle capping or trim of any suitable material may be applied over at least the external joints as shown. Where the preferred 75 mm EPS sandwich panels (with Colorbond® steel facings and aluminium perimeter capping) are utilised in accordance with the present invention, 70 mm×70 mm×3 mm Colorbond® aluminium 900 angle capping applied over the external roof/wall 14, 16, 18, 20 & 22 joints using silicon and rivets has been found to create the desired airtight seal between the respective roof and wall 14, 16, 18, 20 & 22 panels.

Floor 12, of coolroom module 10, is horizontally supported above the ground 24, by a base frame 26. Base frame 26 preferably includes at least two bearers 28 and a plurality of joists 30, with the amount of bearers 28 and joists 30 depending on the size and application of coolroom module 10. Each of bearers 28 and joists 30, of base frame 26, may be of any suitable material and shape, but steel or aluminium PFC ("Parallel Flange Channel) bearers 28 and steel or aluminium SHS ("Square Hollow Section") joists 30 have been found to be particularly useful for typical coolroom applications. Although not shown in detail in the drawings, floor 12, of coolroom module 10, which is affixed to the upper side of joists 30, of base frame 26, may comprise any suitable flooring substrate and/or covering material. Whilst any suitable flooring substrate and/or covering material may be utilised for floor 12, of coolroom module 10, in accordance with the present invention, it has been found that a 17 mm FormPly flooring substrate with a 1.6 mm to 2.0 mm checker plate covering is particularly well suited for typical coolroom applications. Similarly, whilst not shown in the drawings, it has also been found that by applying say a 200 mm high piece of checker plate along the base of each wall 16, 18, 20 & 22 panel, and an aluminium coving of say 35 mm×35 mm between the floor 12 and each wall 16, 18, 20 & 22 panel, the wall 16, 18, 20 & 22 panels may be protected from impact by pallets or the like (not shown), and the desired airtight seal between the respective wall 16, 18, 20 & 22 panels and the floor 12 may be enhanced.

As illustrated in FIG. 2 in particular, base frame 26, of coolroom module 10, preferably extends outwardly beyond the rear of coolroom module 10, providing an external surface to support refrigeration components (generally designated 32) of coolroom module 10. Although not shown in detail, any suitable refrigeration components 32 may be utilised in accordance with the present invention in order to provide the required climate control for coolroom module 10. Whilst any suitable refrigeration components 32 may be utilised in accordance with the present invention, it has been found that condenser and evaporator units distributed by Coldpoint Pty Ltd, of Victoria, Australia, in particular model numbers CC14MT-1 and CPC3-37, are particularly well suited for typical coolroom applications.

Base frame 26, of coolroom module 10, is specifically designed to enable coolroom module 10 to be readily transported from site to site, and moved around any one site as required. Depending on their size and application, coolroom modules 10 of the present invention may preferably be transported on trucks (e.g. on tilt trucks or the likes) or semi-trailers, and may either be lifted by a crane or a forklift, as desired. In order to assist with lifting and/or moving a coolroom module 10, base frames 26 of each of coolroom modules 10 may preferably include a series of retractable lifting arms or "lifters" 34 (see, for example, FIGS. 1 & 2), each of which are preferably retractable from within a joist 30 of base frame 26 as shown. Although the use of lifters 34 is described and shown in the drawings, it will be appreciated that such are not essential to the operation of the coolroom modules 10 of the present invention.

To facilitate access into and out of coolroom module 10, at least one access door 36 is provided, preferably on front wall 16 of coolroom module 10, as shown. Access door 36, which may be of any suitable shape, size and material depending on the intended application of coolroom module 10, is preferably affixed to front wall 16 panel of coolroom module 10 by a series of vertically arranged hinges 38, such that access door 36 pivots on a vertical axis. To enable access door 36 to be opened, closed and/or locked as required, access door 36 preferably includes at least one suitable handle and/or latch assembly (which may be a single component, or multiple separate components), generally designed 40, preferably disposed on the opposite side of access door 36 to that of hinges 38. Whilst an access door 36 of any suitable shape and size may be utilised in accordance with the present invention, where coolroom module 10 is required to store palletised goods (not shown), it has been found that an insulated coolroom door 36 which is around 2000 mm high×1300 mm wide×50 mm thick, is particularly well suited for typical coolroom applications.

Given that floor 12, of coolroom module 10, is spaced above the ground 24 by way of base frame 26, to enable goods (not shown), especially palletised goods (again, not shown), to be readily moved into and out coolroom module 10, via access door 36, any suitable ramp 42 (see, for example, FIG. 3), or the likes, may be positioned adjacent access door 36 as desired.

Whilst it will be appreciated that the overall shape and size of coolroom module 10 can readily vary depending on the intended application of coolroom module 10, where storage of palletised goods (not shown) is desired, it is preferred that coolroom module 10 is a rectangular structure having a width of around 3000 mm, a total length of around 6500 mm (including the insulated coolroom structure itself of around 6000 mm between the external surfaces of front and rear walls 16 & 18, and a projecting portion of base frame 26 of around 500 mm which supports refrigeration components 32) and a height of around 2696 mm (including a base frame 26 which supports the upper surface of floor 12 at a height of around 221 mm from the ground 24). Where the preferred 75 mm EPS sandwich panels (with Colorbond® steel facings and aluminium perimeter capping) are utilised for roof 14 and wall 16, 18, 20 & 22 panels, of coolroom module 10, in accordance with the present invention, these preferred rectangular dimensions of coolroom module 10, result in an internal storage area which is around 2850 mm wide×5850 mm long×2400 mm high. Thus, these preferred dimensions of coolroom module 10 result in a floor 12 storage area of around 16.67 $m^2$, which is more than sufficient to enable the storage and maneuverability of at least eight standard 1165 mm×1165 mm pallets of goods (not shown).

Referring to FIGS. 4*a* & 4*b*, in particular, it can be seen that in order to enable coolroom module 10 to be selectively and removably interconnected with other like coolroom modules $\mathbf{10}_x$ to create a larger combined coolroom environment in accordance with modular coolroom system 100 (see, for example, FIGS. 5 to 10) of the present invention, coolroom module 10 includes at least one, but preferably two as shown, removable left and/or right side wall (20 & 22) infill panels 44. The or these infill panels 44, which are preferably generally rectangular in shape (but which may be any other suitable shape as desired), may be made of any suitable insulated material and may vary in thickness depending on the application of coolroom module 10. Whilst any suitable insulated infill panel 44 material, and thickness thereof, may be readily used in accordance with the present invention, like in the case of preferred roof 14 and wall 16, 18, 20 & 22 panels described earlier, it has been found that insulated infill panel(s) 44 of a thickness of around 75 mm having an EPS ("Expanded Polystyrene") core sandwiched between two Colorbond® steel facings, and aluminium perimeter capping of around 75 mm×38 mm, are particularly well suited for typical coolroom applications. In addition, so that infill panel(s) 44 may be readily removably affixed (using any suitable sealant(s) and/or fastening means—not shown) to its corresponding side wall 20 or 22 panel, each infill panel 44 preferably includes a 900 angle piece 46 (of any suitable size and material, such as, for example, a 40 mm×40 mm×1.6 mm Colorbond® aluminium 900 angle piece) disposed along at least its top and side peripheral edges as shown, but possibly also along its bottom peripheral edge (not shown).

Each infill panel 44 (which may be of any suitable shape and size) when selectively removed from coolroom module 10, exposes an opening in a respective left and/or right side wall 20 and/or 22 of coolroom module 10, which is preferably horizontally centrally located as shown, and which extends vertically from the upper surface of floor 12, of module 10, to a point which is preferably around 70 to 90% of the height of side wall 20 or 22 panel, more preferably around 80 to 85% of the height of side wall 20 or 22 panel, and in a particularly preferred embodiment, around 83% of the height of side wall 20 and/or 22 panel. When horizontally centrally located as shown, it is preferred that the opening exposed by removing an infill panel 44 is around 50 to 70% of the length of side wall 20 and/or 22, more preferably around 55% to 65% of the length of side wall 20 and/or 22, and in a particularly preferred embodiment, around 60% of the length of side wall 20 and/or 22. This preferred arrangement of the positioning of the opening(s) exposed by removing infill panel(s) 44 from side wall(s) 20, 22, of coolroom module 10, ensures that the structural integrity of coolroom module 10 is maintained when infill panel(s) 44 are selectively removed from the side wall or walls 20, 22, of coolroom module 10. To further ensure that the structural integrity of coolroom module 10 is maintained when infill panel(s) 44 is/are selectively removed therefrom, it is preferred that left and/or right side wall 20, 22 panels, of coolroom module 10, are reinforced around the infill panel openings by any suitable means, such as, for example, by utilising 75 mm×75 mm×3 mm steel or aluminium SHS $\mathbf{48}_x$ (see, for example, items 482 & 483 in FIGS. 7*a* to 7*c*) which is preferably sandwiched between the Colorbond® facings of side wall panel 20, 22, and which may also preferably include a 75 mm×30 mm Colorbond® aluminium capping or the likes (not shown). Similarly, although not shown in the drawings, it is also preferred that base frame 26, of coolroom module 10, is also reinforced under floor 12 relative to the infill panel openings by any suitable means, such as, for example, by adding a 75 mm×50 mm RHS ("Rectangular Hollow Section") under the applicable section of the preferred 17 mm FormPly substrate, along with a 75 mm×40 mm Colorbond® aluminium angle threshold which caps the floor 12 structure (i.e. the preferred 17 mm FormPly substrate with the preferred 1.6 mm to 2.0 mm checker plate covering) at its otherwise exposed edges relative to the infill panel opening on the side wall or walls 20, 22, of coolroom module 10.

Whilst infill panel(s) 44 of any suitable shape and size may be utilised in accordance with the present invention, where coolroom module 10 has the preferred dimensions outlined above which are suitable for storing palletised goods (not shown) within coolroom module 10, it has been found that infill panel(s) 44 which are around 3685 mm long (including the 900 angle pieces 46 disposed on both peripheral side edges), around 2040 mm high (including the 900 angle piece 46 disposed on the top peripheral edge), and around 75 mm thick, are particularly well suited for typical coolroom applications. These preferred dimensions of infill panel(s) 44, results in an opening on one or both side walls 20, 22, of coolroom module 10, which is around 3600 mm wide by around 2000 mm high. Hence, when multiple coolroom modules $10_x$ are selectively interconnected with one another to create a larger combined coolroom environment in accordance with modular coolroom system 100 (see, for example, FIGS. 5 to 10) of the present invention, the mating openings of two adjacent coolroom modules $10_x$ readily enable goods (not shown), especially palletised goods (again, not shown), to be moved internally from one module $10_x$ to another modules $10_x$. Thus, there is no need to move goods (not shown) in and out of the various coolroom modules $10_x$ in accordance with the modular coolroom system 100 of the present invention.

To assist with installing and/or removing the or each infill panel(s) 44 on/from coolroom module 10, each infill panel(s) 44 is preferably provided with at least two handles 50 (which may be recessed, as shown) on at least its external side/surface. Whilst any suitable handles 50 may be utilised in accordance with the present invention, it has been found that handles distributed by Concept Latch Lock & Hinge, of Victoria, Australia, in particular model number CLLH-CH906, are particularly well suited for typical coolroom applications.

Reference will now be made to FIGS. 5 to 10, in particular, in order to provide a better understanding of how multiple preferred coolroom modules $10_x$ of the present invention may be utilised as part of preferred module coolroom system 100 of the present invention. In FIGS. 5 to 10, each of the plurality of coolroom modules $10_x$ of modular coolroom system 100 are designated by the number 10 followed by a subscript number, i.e. $10_1$ to $10_3$ as shown, to readily distinguish between the respective coolroom modules $10_x$. For this reason, where other components of a respective individual coolroom module $10_x$ are shown in these drawings, the same subscript number is also used beside each reference number that corresponds to the components of that coolroom module $10_x$. For example, for coolroom module $10_1$ in FIG. 5, the numbering convention used for the roof of that module is $14_1$, and so on. Whilst only three coolroom modules $10_1$ to $10_3$ are shown in each of FIGS. 5 to 10, it should be appreciated that any desired and/or suitable amount of coolroom modules $10_x$ may be readily used in accordance with modular coolroom system 100 of the present invention.

In each of FIGS. 5 and 8 to 10, three coolroom modules $10_1$ to $10_3$ are shown as having been already interconnected with one another creating a larger combined coolroom environment in accordance with modular coolroom system 100 of the present invention. Whereas in FIGS. 6*a* & 7*c*, a third coolroom module $10_3$ is shown in the process of being interconnected with two existing interconnected coolroom modules $10_1$ & $10_2$ in order to create a larger combined coolroom environment in accordance with modular coolroom system 100 of the present invention. In each of these drawings, it can readily be seen that when multiple coolroom modules $10_x$ are selectively and removably connected to one another in accordance with modular coolroom system 100 of the present invention, the end result is a single combined generally open coolroom environment and not multiple separate coolroom environments which would otherwise be created by using multiple known transportable coolrooms, such as, "Reefers", portable coolroom trailers, or the likes.

Referring to FIGS. 6*a* to 7*c*, a preferred method of interconnecting multiple coolroom modules $10_x$ in accordance with modular coolroom system 100 of the present invention will now be described in detail. Although a preferred method describing how multiple coolroom modules $10_x$ may be interconnected with one another in accordance with modular coolroom system 100 will now be described in detail, it will be appreciated that this preferred method only illustrates an example of the way in which multiple coolroom modules $10_x$ may be interconnected with one another. Many other methods (not shown) may be utilised to achieve the same or similar result and as such the present invention should not be construed as limited to the specific example provided.

Figure 6A:
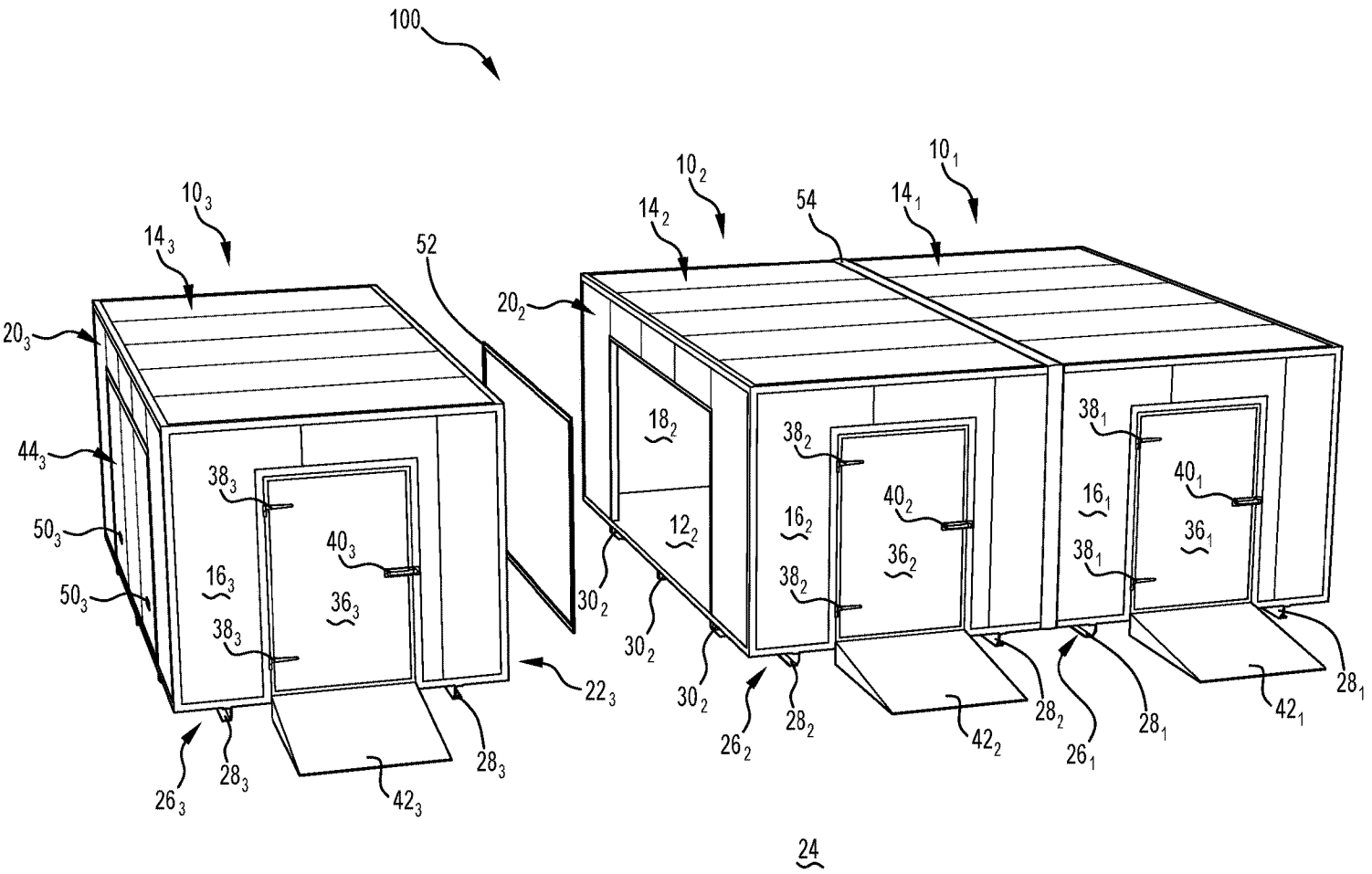
FIGS. 6*a* & 6*b* are front perspective views showing in stages how a third preferred coolroom module may be interconnected with two existing interconnected coolroom modules in order to create a larger combined coolroom environment in accordance with the preferred modular coolroom system of the present invention.
Figure 6B:
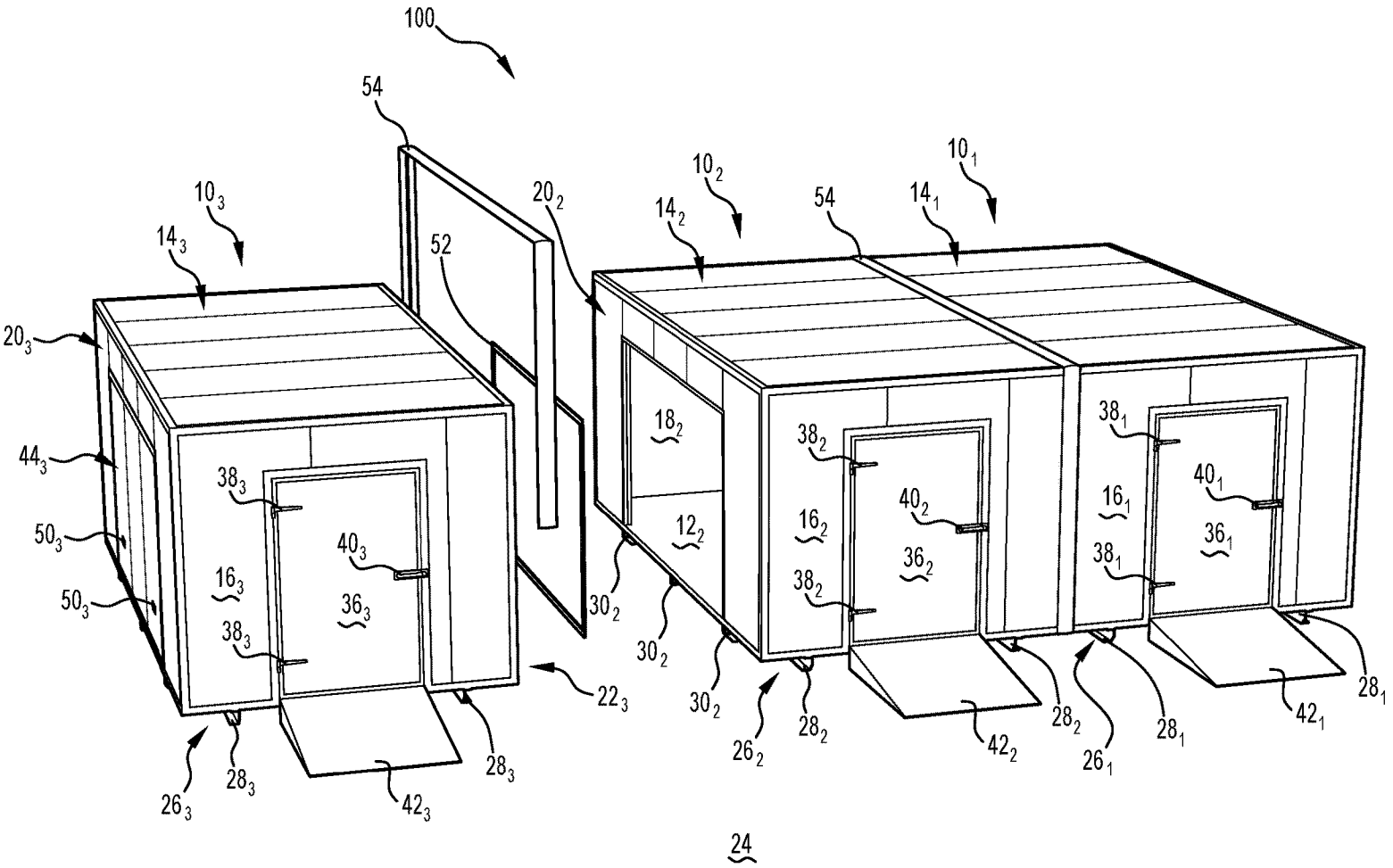

The preferred method of selectively and removably interconnecting multiple coolroom modules $10_x$ together in accordance with modular coolroom system 100 of the present invention preferably starts with the arrangement of the required number of coolroom modules $10_x$ side-by-side on a flat ground surface 24. For example, and as shown in FIGS. 6*a* & 6*b*, where a third coolroom module $10_3$ is to be selectively interconnected with a second coolroom module $10_2$ (in this example, of two existing interconnected coolroom modules $10_1$ & $10_2$), that third coolroom module $10_3$ is first arranged beside second coolroom module $10_2$, such that the opposing side walls $22_3$ & $20_2$, of coolroom modules $10_3$ & $10_2$, are roughly aligned with one another ready to be mated therewith. The infill panels 44 of both of the opposing side walls $22_3$ & $20_2$, of coolroom modules $10_3$ & $10_2$, are then removed (if not removed beforehand) and may be stored for future use as required. A suitable sealing tape 52, or sealant (not shown), is then preferably applied to at least one of the opposing side walls $22_3$ or $20_2$, but preferably to both of the opposing side walls $22_3$ & $20_2$ (as shown in, for example, FIGS. 7*a* to 7*c*), of coolroom modules $10_3$ & $10_2$, preferably all the way around the external infill panel openings of one or both opposing side walls $22_3$ and/or $20_2$. Whilst any suitable sealing tape 52 may be utilised in accordance with the present invention, it has been found that low density PVC ("Polyvinyl Chloride") closed-cell foam sealing tape applied to at least one, but preferably to both, opposing side walls $22_3$ and/or $20_2$, of coolroom modules $10_3$ & $10_2$, is particularly well suited to creating an airtight seal between opposing coolroom modules $10_3$ & $10_2$ in accordance with the present invention. In particular, it has been found that low density PVC closed-cell foam sealing tape distributed by Gaska Tape Australia, of Victoria, Australia, in particular part number V710, which is 19 mm thick×50 mm wide and supplied on a 5000 mm roll, is particularly well suited for typical coolroom applications in accordance with the present invention. This particular Gaska tape has been found to readily provide a long-life seal against air, moisture and dust penetration when compressed by 30% of more between respective opposing side walls (e.g. opposing walls $22_3$ & $20_2$) of coolroom modules $10_x$ (e.g. respective coolroom modules $10_3$ & $10_2$, as shown in FIGS. 6*a* to 7*c*).

After applying the desired sealing tape 52, or sealant (not shown), to one or both opposing side walls $22_3$ and/or $20_2$, of coolroom modules $10_3$ & $10_2$, preferably around the infill panel openings, the opposing coolroom modules $10_3$ & $10_2$ are then carefully moved or drawn into close proximity with one another (i.e. say to within around 50 mm to 100 mm from one another) using, for example, a crane, forklift or one or more suitable ratchet(s) or pulley(s) (not shown). Where ratchet(s) or pulley(s) are utilised, it is preferred that such are temporarily connected between the respective base frames $26_3$ & $26_2$ of coolroom modules $10_3$ & $10_2$. After drawing or moving the opposing coolroom modules $10_3$ & $10_2$ into close proximity with one another, and after ensuring that those modules $10_3$ & $10_2$ (and the preferred opposing sealing tape 52 surfaces) are correctly aligned with one another, a or the ratchet(s) or pulley(s) (not shown) is/are then used to draw the respective coolroom modules $10_3$ &

Figure 7C:
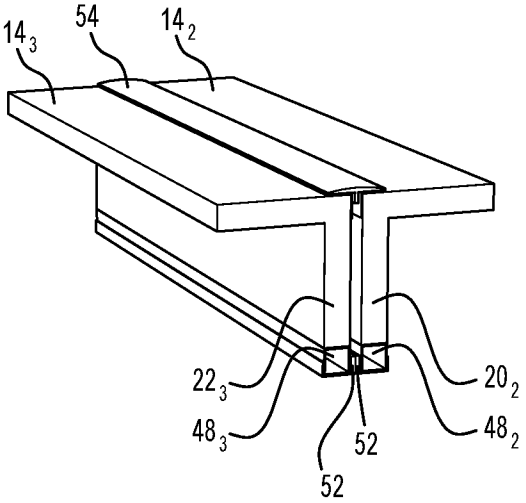
FIGS. 7*a* to 7*c* are partial cross-sectional perspective views illustrating in preferred stages how multiple preferred coolroom modules may be interconnected with one another to create a larger combined coolroom environment in accordance with the preferred modular coolroom system of the present invention.
Figure 7B:
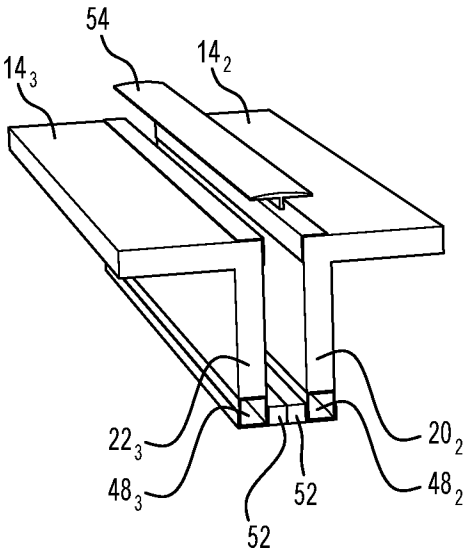
Figure 7A:
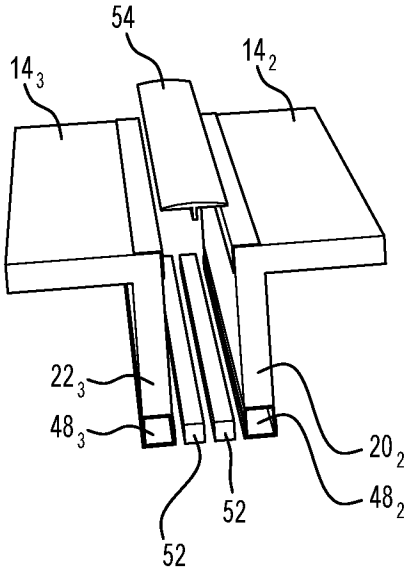
Figure 8:
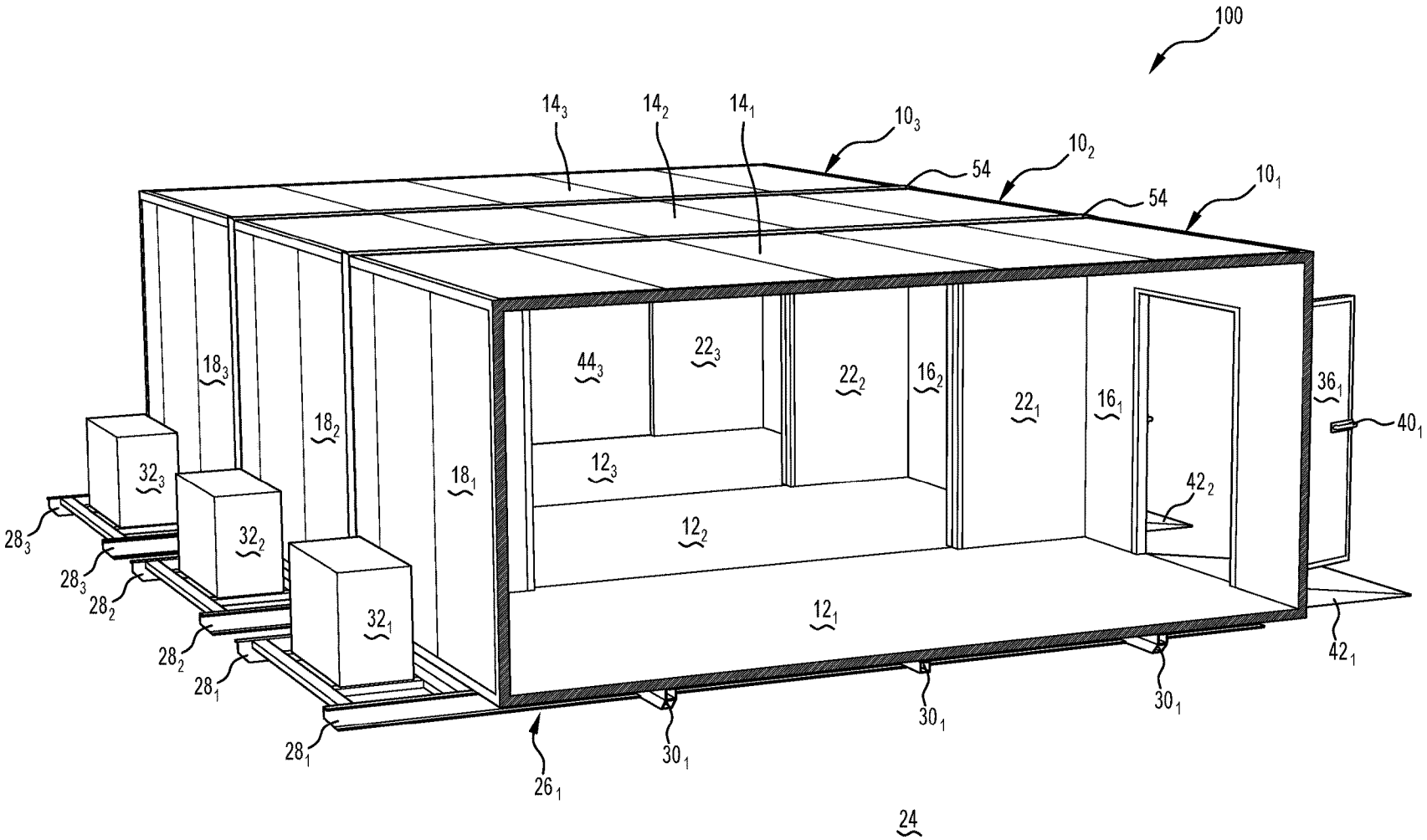
FIG. 8 is a rear perspective view of three preferred coolroom modules interconnected with one another creating a larger combined coolroom environment in accordance with the preferred modular coolroom system of the present invention, a side wall of one of the coolroom modules being completely removed for illustrative purposes only, so as to illustrate the internal combined open coolroom environment created by the modular coolroom system of the present invention.
Figure 9:
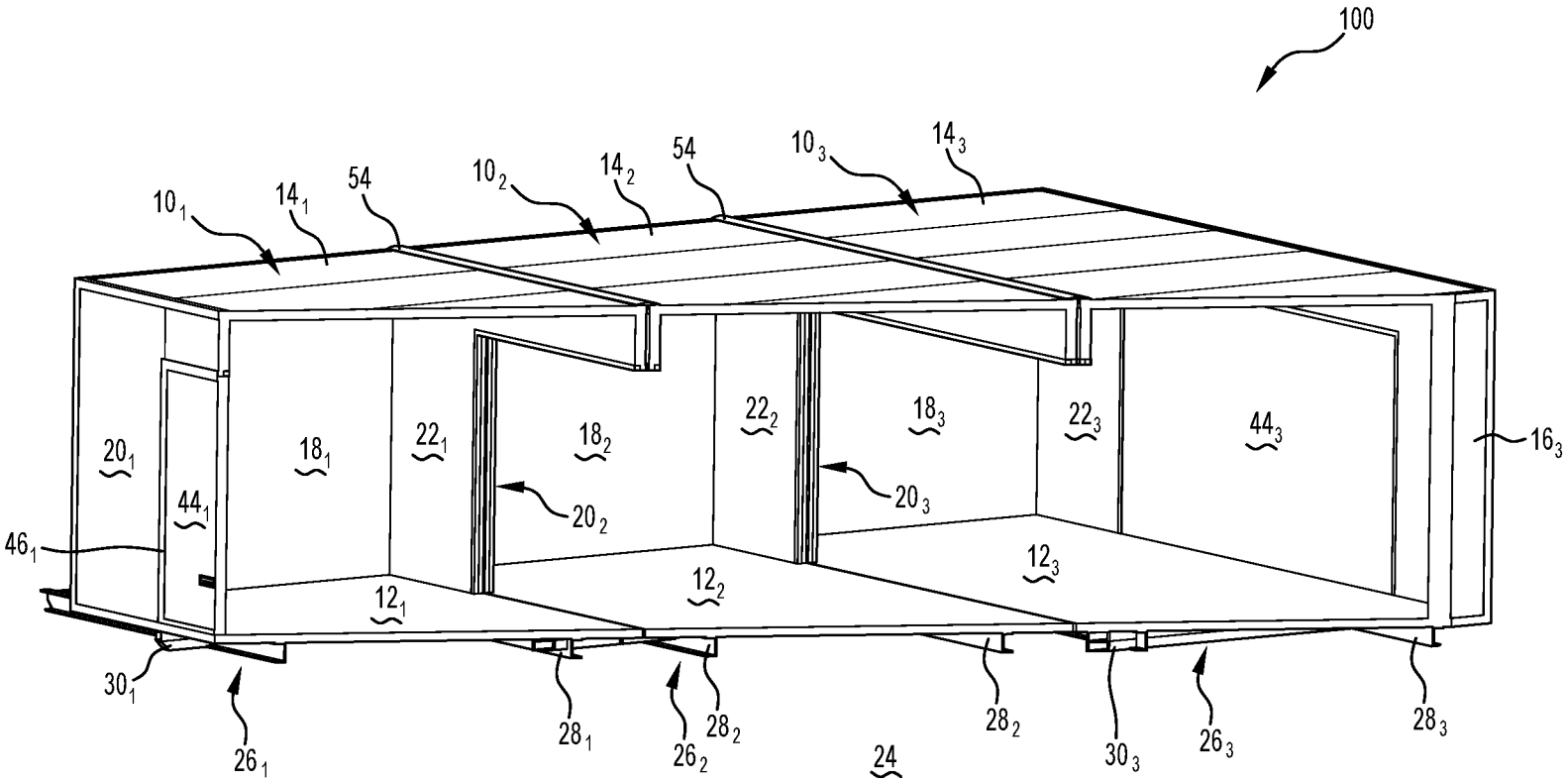
FIG. 9 is a cross-sectional front perspective view of three preferred coolroom modules interconnected with one another creating a larger combined coolroom environment in accordance with the preferred modular coolroom system of the present invention, the cross-sectional detail illustrating the internal combined open coolroom environment created by the modular coolroom system of the present invention; and, FIG. 10 is a cross-sectional front view of three preferred coolroom modules interconnected with one another creating a larger combined coolroom environment in accordance with the preferred modular coolroom system of the present invention, the cross-sectional detail again illustrating the internal combined open coolroom environment created by the modular coolroom system of the present invention.
Figure 10:
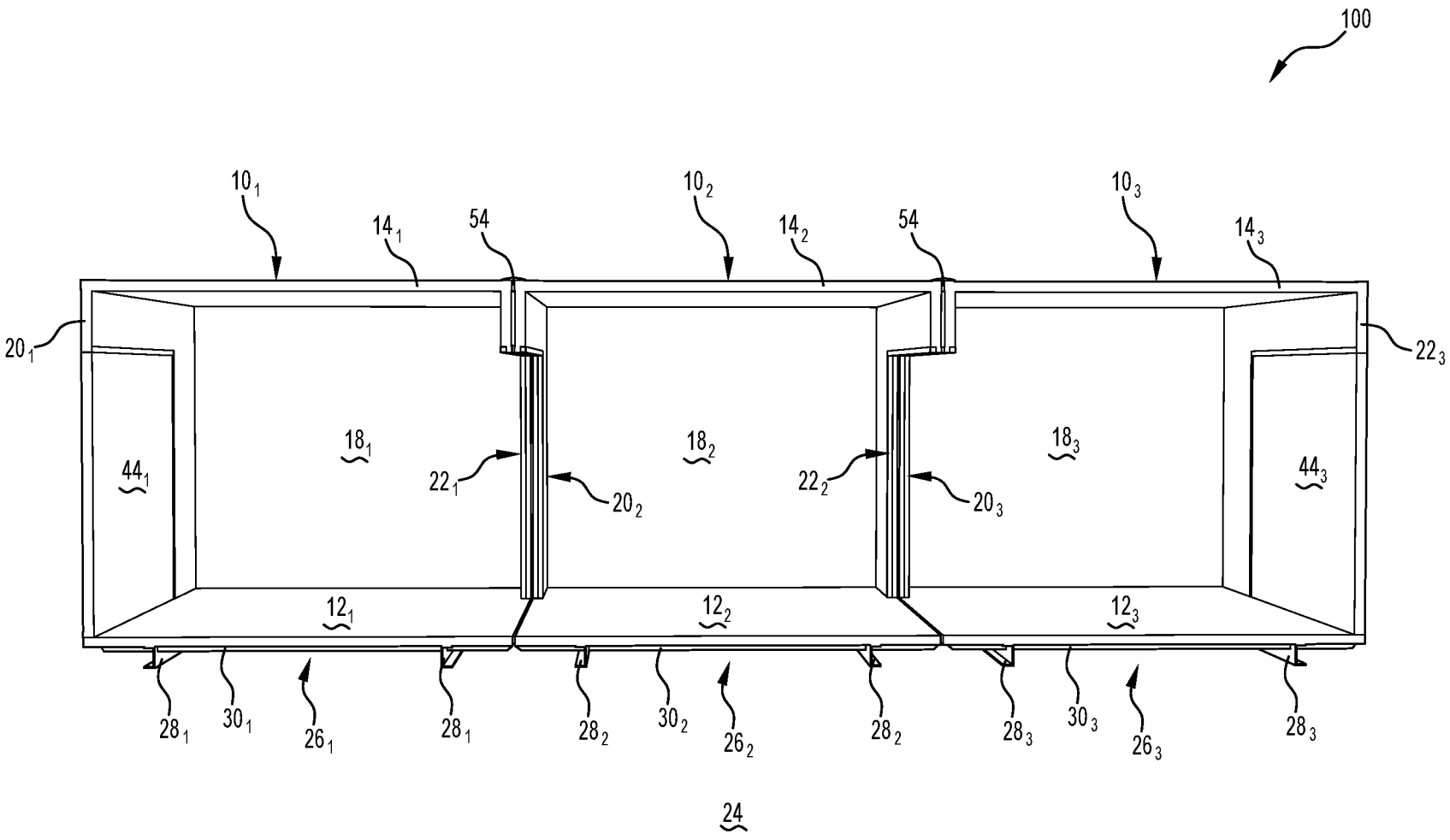

$10_2$ together such that an airtight seal is created therebetween (as illustrated by, for example, FIGS. 7*b* & 7*c*) by way of the sealing tape 52, or sealant (not shown), either by way of the sealing tape 52 (or sealant—not shown) applied to one side wall $22_3$ or $20_2$ panel only compressing against an opposing side wall $22_3$ or $20_2$ panel (this arrangement not being shown in the drawings), or preferably by way of the opposing sealing tape 52 surfaces applied to both side wall $22_3$ & $20_2$ panels compressing against one another (as shown in, for example, FIG. 7*c*). Thereafter, in order to complete and/or maintain the airtight seal created between opposing coolroom modules $10_3$ & $10_2$ (e.g. preferably by way of the sealing tape 52 being compressed by more than 30%), a series of suitable latches or the likes (not shown), such as, for example, a series of suitable over-centre latches (again, not shown), are preferably used to lock the coolroom modules $10_3$ & $10_2$ in place. These latches (not shown) may be disposed on the external front $16_3$ & $16_2$ and rear wall $18_3$ & $18_2$ surfaces of coolroom modules $10_3$ & $10_2$, adjacent to the opposing side walls $22_3$ & $20_2$, and/or internally of the opposing coolroom modules $10_3$ & $10_2$, relative to each of the opposing infill panel openings. Whilst any suitable latches (not shown) may be utilised in accordance with the present invention, it has been found that adjustable stainless steel over-centre latches distributed by Concept Latch Lock & Hinge, of Victoria, Australia, in particular model number OL413SS, are particularly well suited for typical coolroom applications.

Thereafter, the preferred method of selectively and removably interconnecting multiple coolroom modules $10_x$ (e.g. coolroom modules $10_3$ & $10_2$, in FIGS. 6*a* to 7*c*) together in accordance with modular coolroom system 100 of the present invention preferably concludes by applying a suitable flashing 54 over the gaps that exist between the front, back and top surfaces of the opposing (now interconnected) coolroom modules $10_3$ & $10_2$ (as illustrated by, for example, FIG. 7*c*). If desired, a T-piece (not shown) of any suitable material, such as, for example, steel or aluminium, may also then be preferably applied at the base of the infill panel openings between the respective now interconnected modules $10_3$ & $10_2$. Whilst any suitable flashing 54 may be utilised in accordance with the present invention, it has been found that 100 mm Colorbond® aluminium flashing, applied with silicon and rivets or screws, is particularly well suited for typical coolroom applications.

The present invention therefore provides new and useful modular storeroom structures, systems and/or methods, preferably modular coolroom structures, systems and/or methods, wherein individual coolroom modules may be used as stand-alone coolrooms, or may be selectively interconnected with other coolroom modules, as desired, to create a larger combined coolroom environment. Hence, as storage requirements change, coolroom modules can be readily added or removed, as desired, so as to ensure that the right amount of storage space is available as required at any one time. The present invention solves the problem of using multiple separate known transportable coolrooms, such as "Reefers", which create multiple separate coolroom environments, by readily enabling multiple coolroom modules of the present invention to be removably interconnected with one another so as to create a single combined open coolroom environment. Thus, there is no need to move goods in and out of various separate coolrooms in accordance with the modular coolroom system of the present invention. Instead, goods can be readily moved between interconnected modules of the modular coolroom system of the present invention by way of the combined open coolroom environment that is created. Further, by enabling the creation of a single combined open coolroom environment, the modular coolroom system of present invention may also enable selective storage of large or irregular sized goods that may not readily be stored within separate known transportable coolrooms.

While this invention has been described in connection with specific embodiments thereof, it will be understood that it is capable of further modification(s). The present invention is intended to cover any variations, uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the attached claims. Various modifications and equivalent arrangements are intended to be included within the spirit and scope of the invention. Therefore, the specific embodiments are to be understood to be illustrative of the many ways in which the principles of the present invention may be practiced.

Where the terms "comprise", "comprises", "comprised" or "comprising" are used in this specification, they are to be interpreted as specifying the presence of the stated features, integers, steps or components referred to, but not to preclude the presence or addition of one or more other features, integers, steps, components to be grouped therewith.

The invention claimed is:

1. A transportable coolroom module comprising:

a base frame;

a coolroom structure mounted on said base frame, said coolroom structure including a floor, a plurality of insulated walls each extending above said floor, and a roof supported only by said plurality of insulated walls;

at least one insulated access door provided in at least one of said plurality of insulated walls of said coolroom structure; and, at least one removable insulated infill panel provided in at least one other of said plurality of insulated walls of said coolroom structure;

wherein, when said at least one removable insulated infill panel is attached to said coolroom structure, said transportable coolroom module may be used as a stand-alone coolroom; and, wherein, when said at least one removable insulated infill panel is selectively removed from said coolroom structure, said transportable coolroom module may be selectively interconnected with one or more other like transportable coolroom modules to create a larger combined coolroom environment.

2. The transportable coolroom module as claimed in claim 1, wherein said coolroom structure is generally rectangular in shape and includes a front, a rear, a left and a right side insulated wall, respectively.

3. The transportable coolroom module as claimed in claim 2, including wherein only one insulated access door is provided in the front or the rear insulated wall.

4. The transportable coolroom module as claimed in claim 2, including wherein only one removable insulated infill panel is provided in one of the left and right side insulated walls.

5. The transportable coolroom module as claimed in claim 2, wherein including two removable insulated infill panels are provided, with one provided in each of the left and right side insulated walls.

6. The transportable coolroom module as claimed in claim 1, wherein the or each removable insulated infill panel is horizontally centrally located on a left and/or a right side insulated wall, and extends vertically from the floor to a point which is around 70 to 90% of the height of the left and/or right side insulated wall.

7. The transportable coolroom module as claimed in claim 6, wherein an infill opening exposed by selectively removing the or each removable insulated infill panel is around 50 to 70% of the length of the left and/or right side insulated wall.

8. The transportable coolroom module as claimed in claim 1, wherein each removable insulated infill panel includes at least one handle to assist with selectively installing and/or removing the or each removable insulated infill panel to/from said coolroom structure.

9. The transportable coolroom module as claimed in claim 1, wherein said coolroom structure is adapted for storing palletised goods.

10. The transportable coolroom module as claimed in claim 1, wherein a ramp may be selectively positioned at the or each insulated access door to assist with moving goods into and out of said coolroom structure.

11. A modular system for construction of a coolroom structure comprising:

a plurality of transportable coolroom modules according to claim 1; and, interconnecting components for interconnecting the plurality of transportable coolroom modules in order to construct the coolroom structure.

12. The modular system for construction of a coolroom structure as claimed in claim 11, wherein said interconnecting components for interconnecting the plurality of transportable coolroom modules includes sealing tape or sealant and flashing to cover gaps between respective interconnected transportable coolroom modules.

13. A coolroom structure comprising a plurality of transportable coolroom modules as claimed in claim 1 interconnected with one another.

14. A method of constructing a coolroom structure, the method comprising the steps of:

providing a plurality of transportable coolroom modules according to claim 5;

horizontally arranging the plurality of the transportable coolroom modules side-by-side on a substantially flat ground surface;

removing the insulated infill panels from respective opposing insulated wall surfaces of adjacent coolroom modules; and, interconnecting the plurality of transportable coolroom modules to create the coolroom structure.

15. The method of constructing a coolroom structure as claimed in claim 14, wherein said step of interconnecting the plurality of transportable coolroom modules includes:

applying a sealing tape or sealant to at least one, but preferably both, of each of the respective opposing insulated wall surfaces;

successively moving or drawing the respective opposing insulated wall surfaces into contact with one another, such that a substantially airtight seal is created between the respective opposing insulated wall surfaces by way of the sealing tape or sealant; and, applying a flashing over gaps between respective interconnected transportable storage coolroom modules.

16. The transportable coolroom module as claimed in claim 1, wherein the or each removable insulated infill panel is horizontally centrally located on a left and/or a right side insulated wall, and extends vertically from the floor to a point which is around 80 to 85% of the height of the left and/or right side insulated wall.

17. The transportable coolroom module as claimed in claim 16, wherein an infill opening exposed by selectively removing the or each removable insulated infill panel is around 50 to 70% of the length of the left and/or right side insulated wall.

18. The transportable coolroom module as claimed in claim 16, wherein an infill opening exposed by selectively removing the or each removable insulated infill panel is around 55 to 65% of the length of the left and/or right side insulated wall.

19. The transportable coolroom module as claimed in claim 6, wherein an infill opening exposed by selectively removing the or each removable insulated infill panel is around 55 to 65% of the length of the left and/or right side insulated wall.

* * * * *